US005093956A

United States Patent [19]

Saunders et al.

[11] Patent Number: 5,093,956

[45] Date of Patent: Mar. 10, 1992

[54] SNAP-TOGETHER HOUSING

[75] Inventors: Craig M. Saunders, Rocky River; James J. Kopco, Richmond Heights; Robert O. Wraight, Westlake; Paul D. Stephens, Cleveland Heights; Michael F. Wright, Cuyahoga Falls, all of Ohio

[73] Assignee: Royal Appliance Mfg. Co., Cleveland, Ohio

[21] Appl. No.: 464,202

[22] Filed: Jan. 12, 1990

[51] Int. Cl.[5] ..... A47L 9/00

[52] U.S. Cl. ..... 15/351; 15/327.1

[58] Field of Search ..... 15/327.1, 327.2, 350, 15/351, 344

[56] References Cited

U.S. PATENT DOCUMENTS

| | | | |
|---|---|---|---|
| 2,962,740 | 12/1960 | Plantholt | 15/41 |
| 3,344,460 | 10/1967 | Nordeen | 15/351 |
| 3,463,954 | 8/1969 | Latta . | |
| 3,527,968 | 9/1970 | Waltrip . | |
| 3,619,850 | 11/1971 | Rideout et al. | 15/327.2 X |
| 3,622,822 | 11/1971 | Lofstrand . | |
| 3,634,905 | 1/1972 | Boyd | 15/350 |
| 3,766,594 | 10/1973 | Westergren et al. | 15/327.2 X |
| 3,772,726 | 11/1973 | Kupperman et al. | 15/48 |
| 4,079,275 | 3/1978 | Fu . | |
| 4,207,641 | 6/1980 | Leibscher et al. | 15/41 R |
| 4,218,806 | 8/1980 | Cohn | 15/402 |
| 4,219,897 | 9/1980 | Leibscher et al. | 15/41 R |
| 4,282,622 | 8/1981 | Rosendall et al. | 15/41 R |
| 4,380,845 | 4/1983 | Miller et al. | 15/344 |
| 4,642,840 | 2/1987 | Jacob et al. | 15/327.2 X |
| 4,644,605 | 2/1987 | Joss et al. | 15/344 X |
| 4,709,436 | 12/1987 | Berfield et al. | 15/79 R |
| 4,799,460 | 1/1989 | Kuhl | 15/344 |

FOREIGN PATENT DOCUMENTS

| | | |
|---|---|---|
| 1309184 | 10/1962 | France . |
| 2134777A | 8/1984 | United Kingdom . |

*Primary Examiner*—Chris K. Moore

*Attorney, Agent, or Firm*—Fay, Sharpe, Beall, Fagan, Minnich & McKee

[57] ABSTRACT

A snap-together vacuum cleaner housing comprises at least three discrete pieces which can be assembled and disassembled without the use of adhesive, fasteners, or tools. A lock ring comprises two semicircles of different radii. The lock ring encircles discrete portions of the housing and joins them together.

26 Claims, 5 Drawing Sheets

H
50
50
50
54
54
52
G
24

24

56
90
52
E
26
26
56
52

SNAP-TOGETHER HOUSING

BACKGROUND OF THE INVENTION

1. Field of the Invention

This invention pertains generally to housings for small appliances and more specifically to housings for vacuum cleaners.

2. Description of the Related Art

Typically, housings for small appliances, for example vacuum cleaners, have required some securing means to secure parts of the housing together. Typical securing means have been adhesives or fasteners such as screws.

These securing means have proven generally effective but certain areas of deficiency remain.

If the housing parts are glued together by way of adhesive, the housing cannot be easily disassembled without damaging it. Such disassembly is often necessary for maintenance.

Should another type of fastener be used, for example a screw, or bolt and nut, disassembly is possible. However, these loose pieces provide difficulties in manufacturing and assembling the product. Production costs rise due to the extra costs associated with manufacture and inventory of the fastener. Assembly of the vacuum cleaner is more time consuming and care must be taken that the correct fastener is used for each fastening location. Further, servicing such a housing is more difficult in that these fasteners are often misplaced during disassembly. The repairman must stock a variety of these fasteners to effectively service the wide variety of housings present in the small appliance industry.

The present invention contemplates a new and improved housing which is simple in design, effective in use, and overcomes the foregoing difficulties and others while providing better and more advantageous overall results.

SUMMARY OF THE INVENTION

In accordance with the present invention, a vacuum cleaner housing is provided which has at least three discrete pieces. The pieces are selectively assemblable to form the housing, with such assembly requiring no additional materials such as adhesive or fasteners.

In accordance with another aspect of the invention, the discrete pieces of the housing snap together to form the housing.

According to a further aspect of the invention, plurality of pairs of attaching means for attaching one discrete piece of the housing to another are provided. Each pair of attaching means comprises a first and second type element. The first type element is operatively associated with the second type element to selectively join together different discrete parts of the housing.

According to another aspect of the invention, the first type element comprises an elongated extension having a first and second end. The first end of the first type element is generally pointed. The second end of the first type element is fixedly attached to a piece of the housing. A portion of the extension between the first end and the second end is the widest portion of the extension.

According to another aspect of the invention, the elongated extension of the first type element has a ledge between the first and second end. The ledge is formed by a wedge-shaped protrusion from the side of the first end of the extension and is located at the widest portion of the extension. The ledge cooperates with a second type element to secure the first end of the first type element to a second type element, and thereby to join together different discrete parts of the housing.

According to another aspect of the invention, the vacuum cleaner is an upright type vacuum cleaner.

According to another aspect of the invention, the housing encloses an associated motor, dirt bag, and portion of an associated air path.

According to another aspect of the invention, the housing is assembled without adhesive, fasteners, or tools. Rather, such assembly is performed by a person's hands causing the discrete pieces of the housing to snap together.

According to a further aspect of the invention, the housing further comprises a lock ring. The lock ring is operative to encircle portions of at least three discrete pieces of the housing.

According to a further aspect of the invention, the lock ring has a bore therethrough. The lock ring is operative to selectively join together at least three discrete pieces of the housing by receiving portions of the discrete pieces of the housing through the bore.

According to another aspect of the invention, the bore comprises a first semicircle of a first radius and a second semicircle of a second radius. The first radius is less than the second radius.

According to a further aspect of the invention, the first radius is between 10% and 25% less than the second radius.

According to a further aspect of the invention, at least one of the discrete pieces of the housing encircled by the lock ring has a wall thickness. That portion of the discrete piece is in the form of an arc of a circle.

According to a further aspect of the invention, the wall thickness of the portion of the discrete piece of the housing which is encircled by the lock ring is substantially equal to the difference between the first radius and the second radius.

According to a further aspect of the invention, the portion of the discrete piece of the housing which is received within the bore of the lock ring, and the first semicircle, cooperate to selectively receive and associated motor shaft.

According to a further aspect of the invention, a collar is selectively received onto the associated motor shaft between the lock ring and the housing.

According to a further aspect of the invention, the lock ring further comprises a recess in the second semicircle. Also, a bump in the portion of one of the discrete pieces of the housing encircled by the lock ring is selectively receivable by the recess and thereby operative to secure the lock ring to the housing.

According to a still further aspect of the invention, a method of assembling a vacuum cleaner housing comprises the steps of gathering the discrete pieces of the housing together; positioning the pieces in their assembled position relative to each other; and snapping the discrete pieces together.

According to another aspect of the invention, a method of assembling a vacuum cleaner housing comprises the steps of gathering discrete pieces of the housing together; positioning the discrete pieces in their assembled position relative to each other; and, snapping the discrete pieces together.

According to a further aspect of the invention, a method of disassembling a vacuum cleaner housing comprises the steps of inserting a prying means into the seam between discrete portions of the housing; and, snapping apart the discrete pieces of the housing by applying separating force to the seam through the prying means.

One advantage of the present invention is the provision of a vacuum cleaner housing which can be snapped together without the need for adhesive, fasteners, or additional tools. This features lowers the cost of manufacture, assembly, and inventory.

Another advantage of the invention is that the housing may be selectively disassembled without damaging the housing. This feature is helpful for maintenance of the vacuum cleaner.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DESCRIPTION OF THE PREFERRED EMBODIMENT

Figure 1:
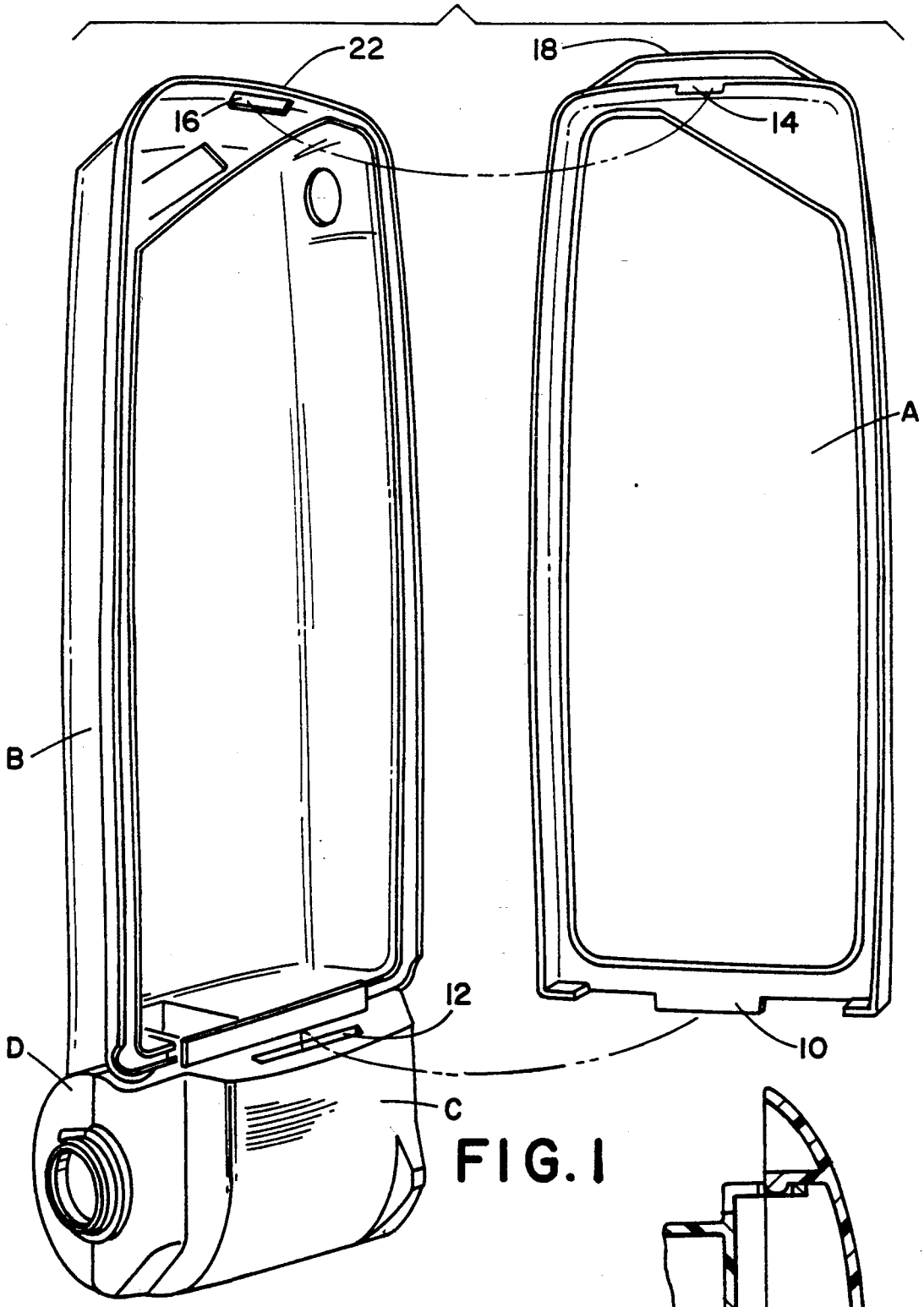
FIG. 1 is an exploded, perspective view of a vacuum cleaner housing according to the present invention.
Figure 2:
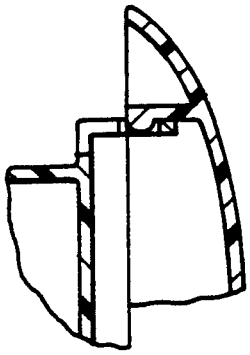
FIG. 2 is an enlarged, side cross-sectional assembled view of the fastening elements used to join the discrete parts of the housing of FIG. 1.

Referring now the drawings wherein the showings are for purposes of illustrating a preferred embodiment of the invention only and not for purposes of limiting same, FIG. 1 and FIG. 2 show a back housing B and a front panel A of a vacuum cleaner housing according to the present invention. The front panel A is selectively affixed to the back housing B by way of tabs 10, 14 and slots 12, 16. The front panel A is preferably made of a plastic material which is easily deformed by forces generated by a person's hands. To assemble front panel A to back housing B, tab 10 is inserted in slot 12. Next, tab 14 is aligned with slot 16. Pressure from the user's hands is applied at the top edge 18 of the front panel A. This pressure causes tab 14 it deflect enough to slide over the top edge 22 of the back housing B, and rest in slot 16. The procedure to remove the front panel A from the back housing B simply reverses the steps. Specifically, the top edge 18 of the front panel A is pulled away from the back housing B until tab 14 slides out of slot 16. In the 5 preferred embodiment, this operation is necessary to change a filter and a dirt bag (not illustrated), which are located in the back housing B. Integrally molded as part of the back housing is a back motor shell half D which cooperates with a front motor shell half C.

Figures 3, 4:
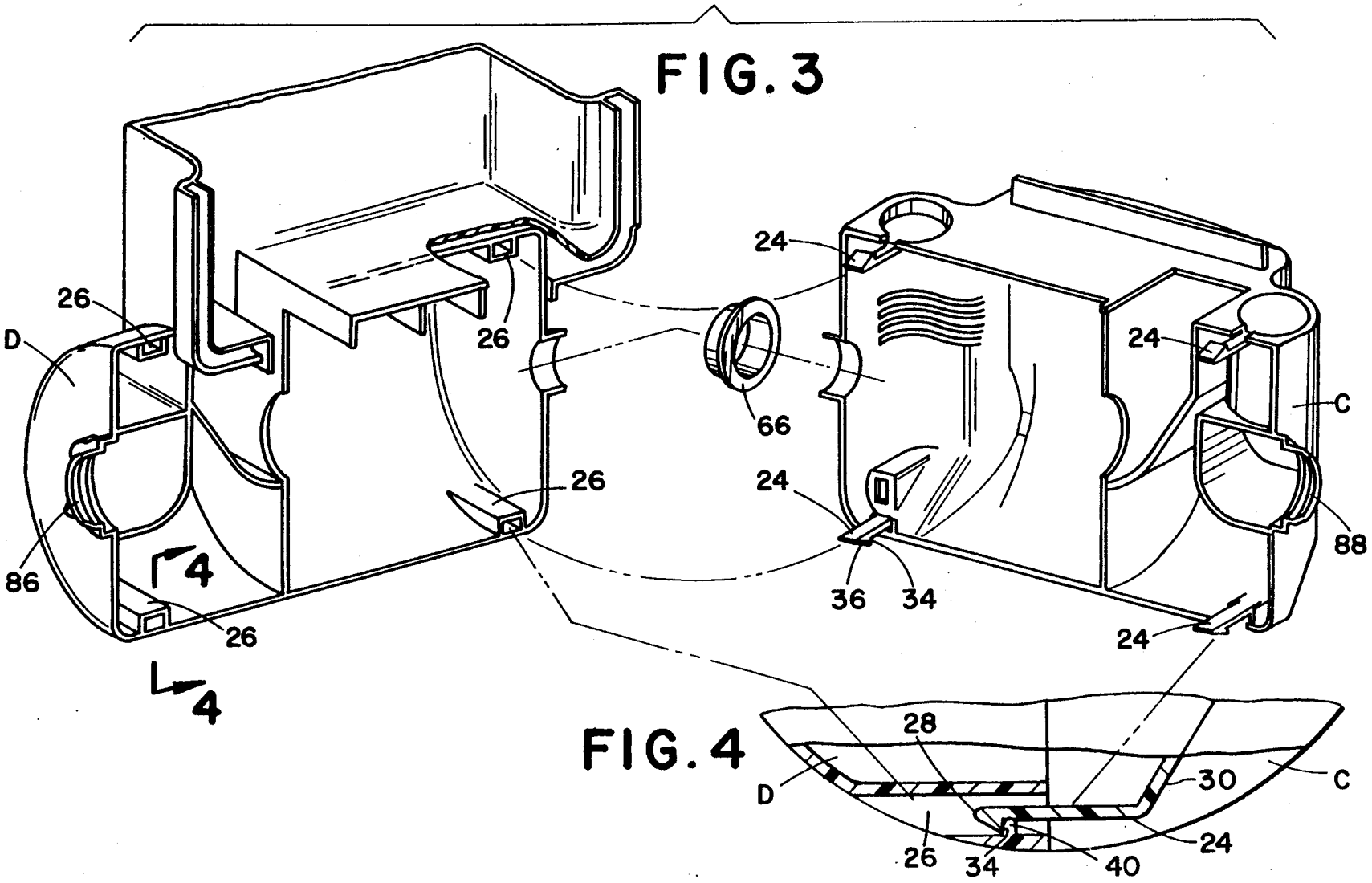
FIG. 3 is an exploded, perspective view of the front and back motor shell halves, two discrete parts of the vacuum cleaner housing and a collar.
FIG. 4 is an enlarged, side, cross-sectional assembled view of FIG. 3 showing the operation of the fastening elements used to join the discrete parts of the housing shown in FIG. 3.

With reference to FIG. 3, the motor shell halves C, D provide a housing for an associated electric motor (not illustrated) which drives the vacuum cleaner. The front motor shell half C snaps onto the back motor shell half D by way of fastening means 24, 26. A first type fastening element 24 comprises an elongated extension having a first end 28 and a second end 30. A ledge 34 is formed by a wedge-shaped protrusion 36 which protrudes from the side of the first end 28 of the first type 24 fastening element.

With continuing reference to FIG. 4, the second type fastening element 26 is characterized by a lip 40 which cooperates with the ledge 34 of the first type fastening element 28 to secure the first type fastening element 28 to the second type fastening element 30, and thereby, to secure the front motor shell half C to the back motor shell half D.

Figure 5:
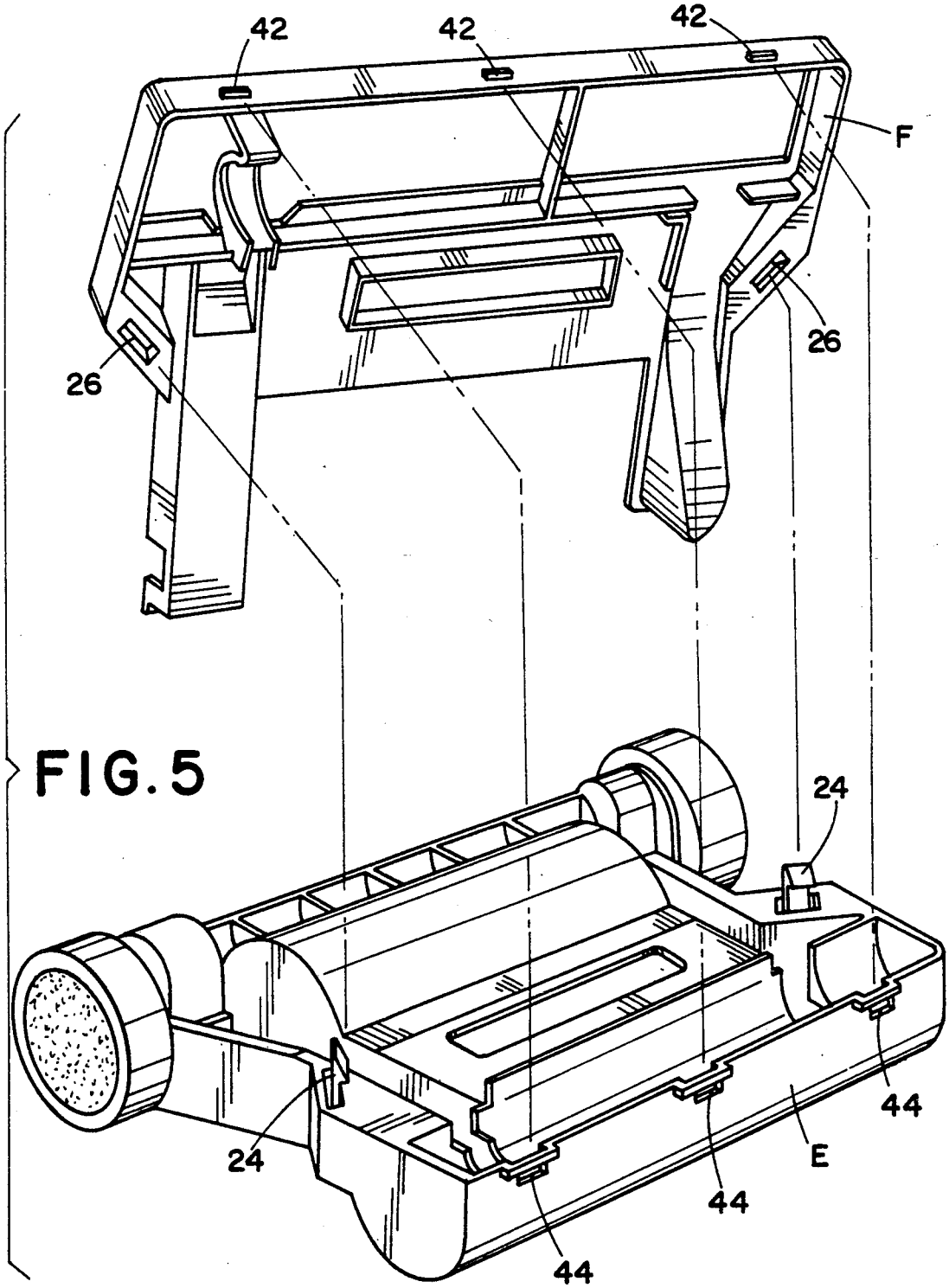
FIG. 5 is a exploded, perspective view, upside down, of the nozzle guard and the nozzle base, two discrete parts of the housing.

With reference to FIG. 5, the nozzle base E and the nozzle guard F are two additional discrete parts of the vacuum cleaner housing. FIG. 5 is viewed with the nozzle base E and the nozzle guard F being upside down in relation to their normal orientation and is being shown this way for purposes of illustration only. The nozzle guard F is snapped together with the nozzle base E by means of a pair of first type fastening elements 24 and a pair of second type fastening elements 26. Additionally, three tabs 42 across the front of the nozzle guard F cooperate with three slots 44 across the front of the nozzle base E. By way of the fastening elements 24, 26, 42, 44, the nozzle guard snaps onto the nozzle base without need for adhesive, other fasteners, or tools.

Figures 6, 7, 8, 9:
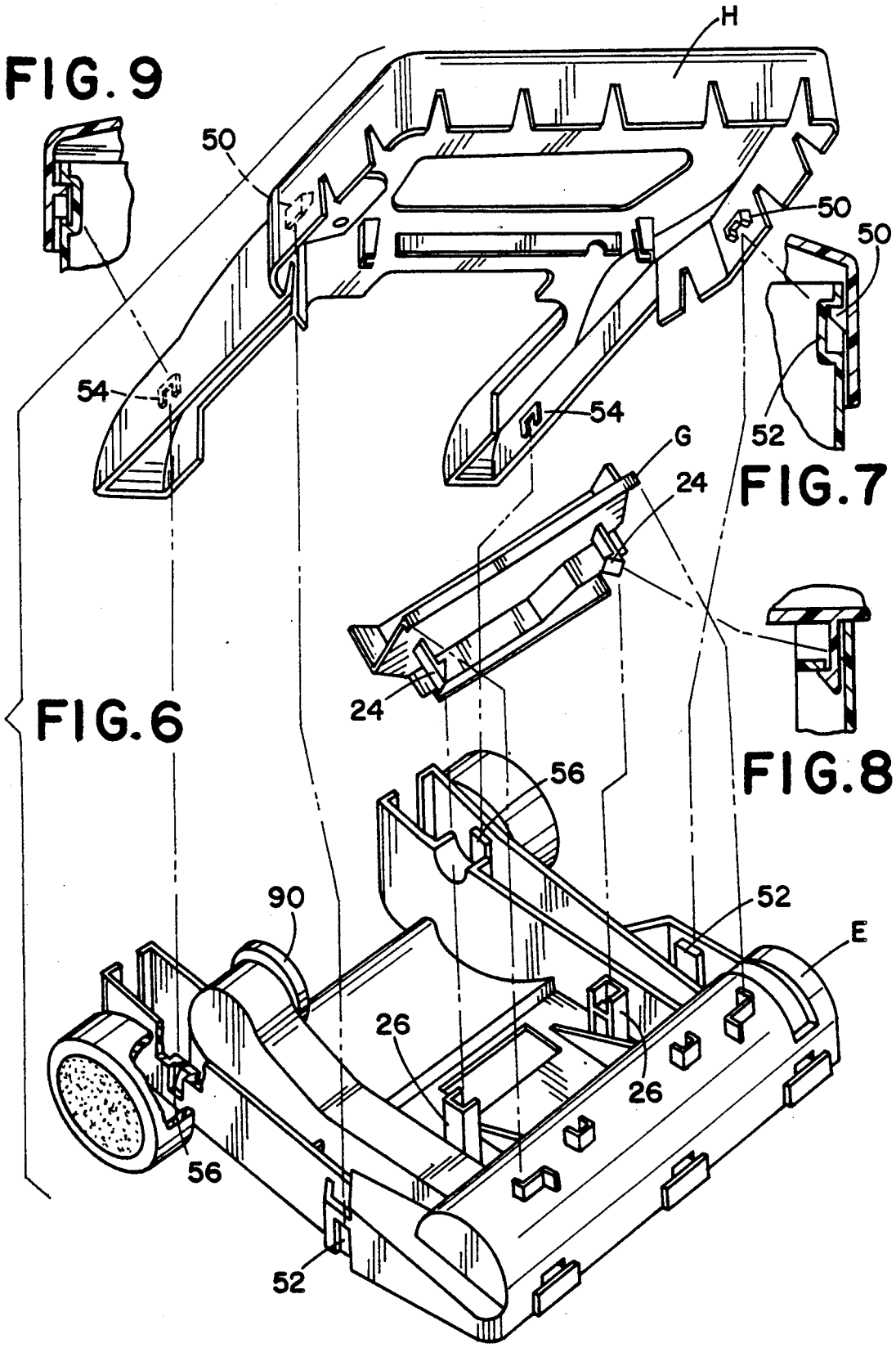
FIG. 6 is an exploded, perspective view of the nozzle base, light bracket; and nozzle cover which are three discrete parts of a housing according to the present invention.
FIG. 7 is an enlarged cross-sectional assembled view of an attaching means used to join the nozzle cover to the nozzle base.
FIG. 8 is a enlarged, cross-sectional assembled view of an attaching means used to join the light bracket to the nozzle base.
FIG. 9 is an enlarged, side, cross-sectional assembled view of an attaching means used to join the nozzle cover to the nozzle base.

With reference to FIG. 6, the assembly of a nozzle base E, a light bracket G, and a nozzle cover H is described. The light bracket G snaps onto the nozzle base E by means of fastening elements 24, 26. The operation of these fastening elements 24, 26 is also shown in FIG. 8. The nozzle cover H is snapped to the nozzle base E by way of fastener elements 50, 52, 54, and 56. Fastener 50 snaps into and is received by fastener 52. Fastener 54 is snapped into and received by fastener 56. The operation of fastener elements 50, 52 is detailed in FIG. 7 and the operation of fastener elements 54, 56 is detailed in FIGURE 9.

Figure 11:
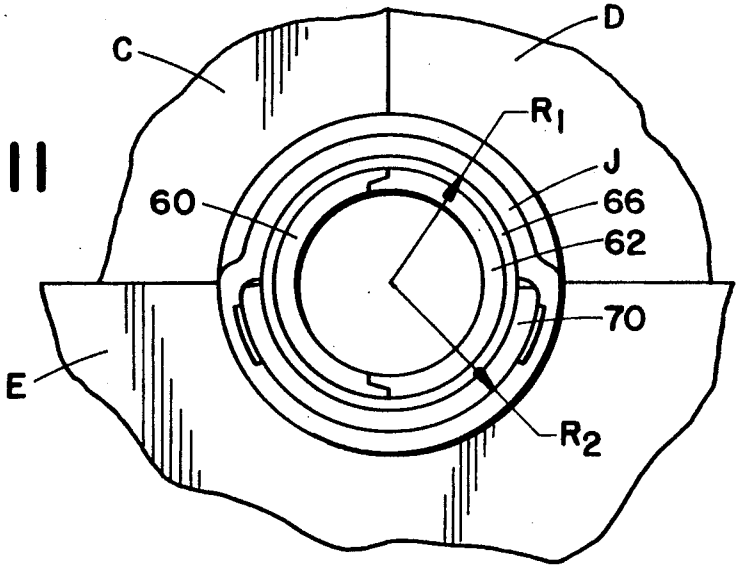
Figure 10:
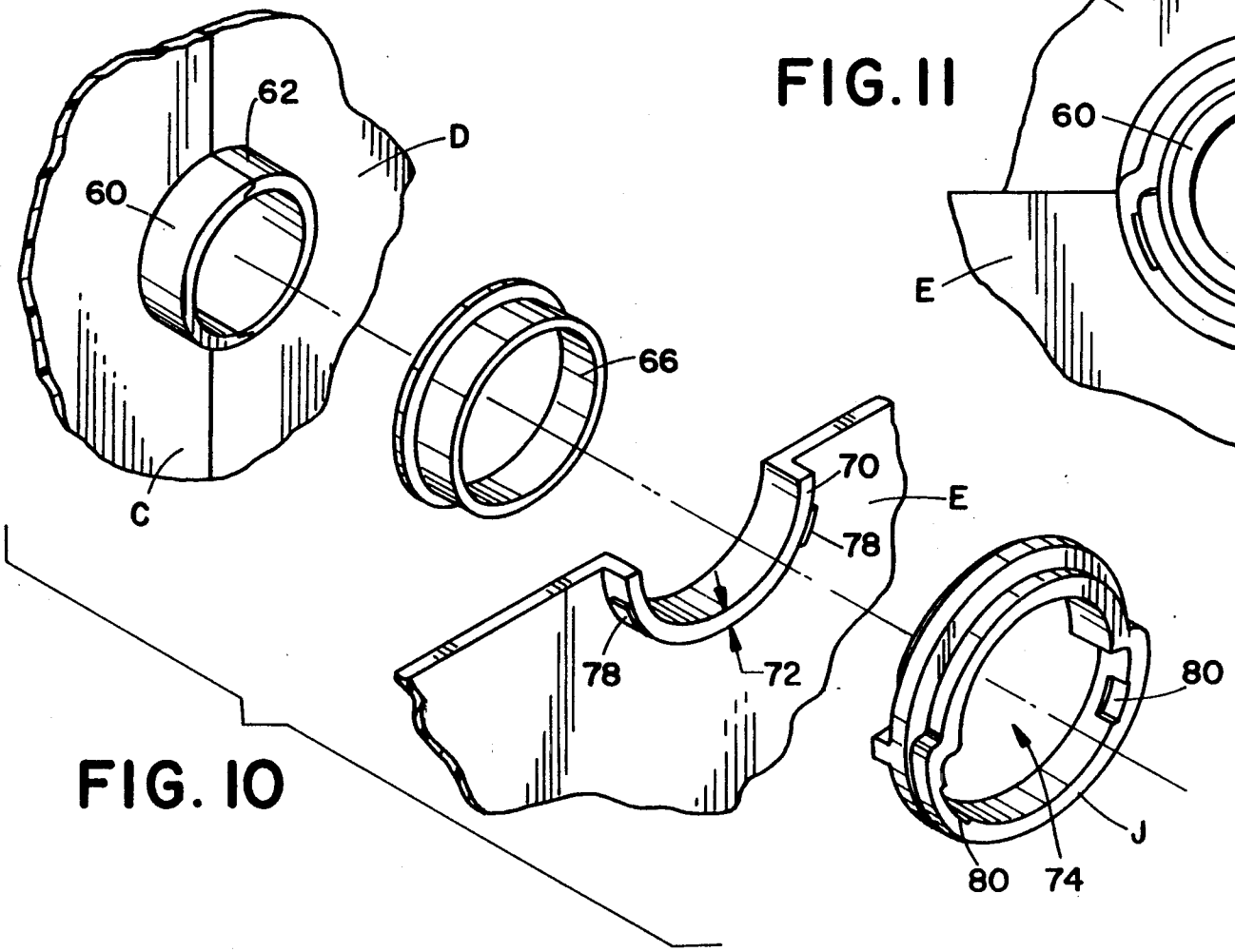
FIG. 10 is an exploded perspective view of the motor shell halves, the collar, the nozzle base, and the lock ring, and their inter-relation; and, FIG. 11 is a front, elevational assembled view of the lock ring, nozzle base, collar, and motor shell halves in assembled position.

With reference to FIG. 10 and FIG. 11, the operation of a lock ring J is illustrated. The front motor shell half C has an extension 60 in the form of a semicircular arc. Likewise, the back motor shell half D has a similar extension 62. When the front motor shell half C and the back motor shell half D are properly assembled, the extensions 60, 62 fit together to form a stub cylinder. A collar 66 made of a suitable lubricating material fits over the extensions 60, 62 and helps to secure them as well as lubricate the movement of the stub cylinder. The nozzle base E also has an extension 70 which is in the form of a semicircular arc. The extension 70 has a wall thickness 72.

The lock ring J has a bore 74 therethrough. The bore 74 is made up of two semicircles. The first semicircle is defined by a first radius R1 and the second semicircle is defined by a second radius R2. The first radius R1 is smaller than the second radius R2 by an amount equal to the wall thickness 72 of the extension 70 of the nozzle base E. This difference in bore radius allows the lock ring J to receive the extension 70 and secure the three discrete parts of the vacuum cleaner housing, namely the nozzle base E, the front motor shell half C and the back motor shell D, together. This construction allows the housing A to pivot on the nozzle base E.

The lock ring J is secured to the nozzle base E by way of bumps 78 and recesses 80. The lock ring J snaps into place as shown in FIG. 11 when the bumps 78 are received into the recesses 80. The dimensions of the bumps 78 and the recesses 80 are such that a slight press fit is obtained, thereby locking the lock ring J to the nozzle base E and thereby securing the front and back motor shell halves C, D, the collar 66, and the nozzle base E.

When fully assembled, the extensions 60, 62 of the front and back motor shell halves C, D receive an associated motor shaft end which extends therethrough.

The invention has been described with reference to a preferred embodiment. Obviously, modifications and alterations will occur to others upon a reading and understanding of this specification. It is intended to include all such modifications and alterations insofar as they come within the scope of the appended claims or the equivalents thereof.

Have thus described the invention, it is now claimed:

1. A vacuum cleaner housing comprising:

at least three discrete pieces, the pieces selectively assemblable to form the housing; assembly means for allowing assembly of the housing pieces, the assembly means comprising integrally formed parts of the housing pieces; and a collar, the collar encircling two discrete pieces of the housing, the collar received by a third discrete piece of the housing, the collar acting as a bushing to allow movement by the two discrete pieces of the housing relative to the third discrete piece of the housing.

2. A vacuum cleaner housing comprising:

at least three discrete pieces, the pieces selectively assemblable to form the housing;

assembly means for allowing assembly of the housing pieces, the assembly means comprising integrally formed parts of the housing pieces; and, a lock ring having a bore therethrough, the lock ring being operative to selectively join together at least three discrete pieces of the housing, the bore comprising a first semicircle of a first radius and a second semicircle of a second radius, the first radius being less than the second radius, at least a portion of one of the discrete pieces of the housing being encircled by the lock ring, that portion having a wall thickness and being in the form of an arc of a circle, the wall thickness being substantially equal to the difference between the first radius and the second radius, the first semicircle and the portion of the discrete piece of the housing that is received within the bore of the lock ring cooperating to selectively receive a collar.

3. The vacuum cleaner housing of claim 2 wherein the collar is selectively received onto an associated motor shaft between the lock ring and the housing.

4. A vacuum cleaner housing, the housing comprising:

first, second, and third housing members, each housing member able to be selectively and repeatedly assembled and disassembled from the other housing members without damage by manually elastically deforming a portion of one of the housing members so that the housing members snap together, wherein said three housing members when assembled cooperate to enclose an associated dirt bag;

assembly means for allowing assembly of the housing members, said assembly means comprising integrally-formed parts of the housing members, the assembly means comprising:

a first type element, the first type element being an elongated extension having first and second ends, the first end of the first type element being generally pointed and having a ledge, the second end being fixedly attached to the first housing member; and, a second type element, the second type element being mounted on the second housing member and having a lip which extends outwardly from the second type element and selectively engages the ledge of the first type element, thereby securing the first housing member to the second housing member.

5. The vacuum cleaner housing of claim 4 wherein the first type element is selectively manually deformable to disengage the ledge from the lip and allow disassembly of the first housing member from the second housing member.

6. A vacuum cleaner housing, the housing comprising:

first, second, and third housing members, each housing member able to be selectively and repeatedly assembled and disassembled from the other housing members without damage by manually elastically deforming a portion of one of the housing members so that the housing members snap together, wherein said three housing members when assembled cooperate to enclose an associated dirt bag;

assembly means for allowing assembly of the housing members, said assembly means comprising integrally-formed parts of the housing members, the assembly means comprising:

a first tab at a first end of the first housing member;

a second tab at a second end of the first housing member;

a first slot in a first end of the second housing member; and, a second slot in a second end of the second housing member, the first tab selectively receivable in the first slot and the second tab selectively receivable in the second slot upon manual deflection of the first housing member.

7. The vacuum cleaner housing of claim 6 further comprising:

a channel extending about the periphery of an interface edge of the second housing member, the channel selectively receiving an edge of the first housing member.

8. The vacuum cleaner housing of claim 6 further comprising:

a grip, the grip located at the first end of the first housing member and extending beyond the interface of the first end of the first housing member and the second end of the second housing member, the grip selectively bent elastically backwardly away from the second housing member, thereby selectively releasing the first tab from the first slot.

9. A vacuum cleaner housing, the housing comprising:

first, second, and third housing members, each housing member able to be selectively and repeatedly assembled and disassembled from the other housing members without damage by manually elastically deforming a portion of one of the housing members so that the housing members snap together, wherein said three housing members when assembled cooperated to enclose an associated dirt bag;

assembly means for allowing assembly of the housing members, said assembly means comprising integrally-formed parts of the housing members, the assembly means comprising:

a shelf extending inwardly toward the interior of a first housing member, the shelf fixed to an interior wall of the first housing, the shelf having ramped sides which slope upwardly and inwardly toward a center of the first housing member;

a recess in the exterior wall of a second housing member, the recess selectively receiving the shelf of the first housing member.

10. The vacuum cleaner housing of claim 9 wherein the first ho using member is attached to the second housing member by pushing the first housing member over the second housing member until an edge of the second housing member is deformed by sliding upwardly and inwardly along the ramped sides until the shelf snaps into the recess.

11. The vacuum cleaner housing of claim 10 wherein the first housing member is removable from the second housing member by manually deforming the first housing member outwardly until the shelf clears the recess and the first housing member can be lifted away from the second housing member.

12. A vacuum cleaner housing, the housing comprising:

first, second, and third housing members, each housing member able to be selectively and repeatedly assembled and disassembled from the other housing members without damage by manually elastically deforming a portion of one of the housing members so that the housing members snap together, wherein said three housing members when assembled cooperate to enclose an associated dirt bag;

assembly means for allowing assembly of the housing members, said assembly means comprising integrally-formed parts of the housing members, and, a collar, the collar encircling two discrete pieces of the housing, the collar received by a third discrete piece of the housing, the collar acting as a bushing to allow movement by the two discrete pieces of the housing relative to the third discrete piece of the housing.

13. A vacuum cleaner housing, the housing comprising:

first, second, third housing members, each housing member able to be selectively and repeatedly assembled and disassembled from the other housing member without damage by manually elastically deforming a portion of one of the housing members so that the housing members snap together, wherein said three housing members when assembled cooperate to enclose an associated dirt bag;

assembly means for allowing assembly of the housing members, said assembly means comprising integrally-formed parts of the housing members, the vacuum cleaner being an upright vacuum cleaner and further comprising:

a handle secured to one of said three housing members, said handle enabling the vacuum cleaner to be pushed back and forth over floors.

14. A vacuum cleaner housing, the housing comprising:

a front panel member, a back housing member, and a front motor shell half housing member, the back housing including a back motor shell half which cooperates with the front motor shell half to receive and secure an associated motor, each housing member able to be selectively and repeatedly assembled and disassembled from the other housing members without damage by manually elastically deforming a portion of one of the housing members so that the housing members snap together; and, assembly means for allowing assembly of the housing members, the assembly means comprising integrally-formed parts of the housing members.

15. The vacuum cleaner housing of claim 14 wherein the assembly means comprises:

a first slot in a top edge of the back housing member;

a first tab near a top edge of the front panel member, the first tab selectively receivable into the first slot;

a second slot in the front motor shell half housing member; and, a second tab near a lower edge of the front panel housing member, the second tab selectively receivable into the second slot.

16. The vacuum cleaner housing of claim 15 further comprising:

a nozzle base housing member having a semicircular depression on an edge thereof; and, a lock ring having a bore therethrough, the bore comprising a first semicircle of a first radius and a second semicircle of a second radius, the difference between the first radius and the second radius being approximately equal to a wall thickness of the edge of the nozzle based housing member.

17. The vacuum cleaner housing of claim 16 wherein the first semicircle of the first radius of the lock ring and the semicircular depression of the edge of the nozzle base housing member cooperate to selectively receive a collar.

18. The vacuum cleaner housing of claim 11 wherein the collar is received onto an associated motor shaft between the lock ring and the housing members.

19. The vacuum cleaner housing of claim 17 wherein the collar is received onto an associated motor shaft, the collar fitting within the lock ring and the semicircular depression in the edge of the nozzle base housing member, the collar encircling extensions of the back housing member and the front motor shell half housing member, the collar acting as a bushing to allow movement by the front motor shell half and back housing members relative to nozzle base housing member.

20. The vacuum cleaner housing of claim 16 wherein the lock ring further comprises:

a recess in the second semicircle; and, a bump in the semicircular depression in the edge of the nozzle base housing member encircled by the lock ring, the bump selectively receivable by the recess and thereby operative to secure the lock ring to the nozzle base housing member.

21. A vacuum cleaner housing comprising:

a primary housing member, a panel, the panel being selectively repeatedly manually elastically deformable without damage, the panel cooperating with the primary housing member to form a chamber suitable for selectively receiving an associated disposable dirt receptacle; and, assembly means for allowing assembly of the panel to the primary housing member, the assembly means comprising integrally-formed parts of the housing member and the panel.

22. The vacuum cleaner housing of claim 21 further comprising:

a grip located near an edge of the panel and operatively adapted for being selectively bent backwardly away from the primary housing member.

23. The vacuum cleaner housing of claim 21 further comprising:

a channel extending about an interface edge of the primary housing member, the interface edge being the interface between the primary housing member and the panel, an edge of the panel being selectively receivable into the channel thereby creating the chamber.

24. The vacuum cleaner housing of claim 21 wherein the assembly means comprises:

a slot in a top edge of the primary housing;

a tab affixed to a top edge of the panel, the tab selectively receivable into the sot upon deformation of the panel; and, a grip affixed to and extending beyond the top edge of the panel, the grip adapted to selectively receive the fingers of a person's hand and to be selectively bent elastically away from the primary housing member.

25. A vacuum cleaner housing, the housing members comprising:

a nozzle base;

a nozzle guard;

a nozzle cover;

a lock ring having a bore therethrough, the lock ring selectively receiving a portion of the nozzle base therethrough; and, assembly means for allowing assembly and disassembly thereof, the assembly means comprising integrally-formed parts of the housing members, the nozzle cover and nozzle guard being selectively affixed to the nozzle base via said assembly means.

26. The vacuum cleaner housing of claim 25 further comprising:

a back housing member;

a front motor shell half housing member, the lock ring receiving a portion of the back housing member and a front motor shell half within its bore, the nozzle base being selectively affixed to the back housing member and the front motor shell half housing member via the lock ring.

* * * * *

UNITED STATES PATENT AND TRADEMARK OFFICE

CERTIFICATE OF CORRECTION

PATENT NO. : 5,093,956

DATED : March 10, 1992

INVENTOR(S) : Craig M. Saunders

It is certified that error appears in the above-identified patent and that said Letters Patent is hereby corrected as shown below:

Claim 8, column 7, line 5, after "selectively" insert --receiving the fingers of a person's hand and selectively--.

Claim 9, column 7, line 17, delete "cooperated" and replace with --cooperate--.

Claim 10, column 7, line 31, delete "ho using" and replace with --housing--.

Claim 24, column 10, line 2, delete "sot" and replace with --slot--.

Signed and Sealed this

Eighth Day of June, 1993

*Attest:*

Michael K. Kirk

MICHAEL K. KIRK

*Attesting Officer*

*Acting Commissioner of Patents and Trademarks*